US006212757B1

(12) United States Patent
Hasegawa

(10) Patent No.: US 6,212,757 B1
(45) Date of Patent: Apr. 10, 2001

(54) AUTOMATIC CUTTING AND CRIMPING APPARATUS

(75) Inventor: Hiroshi Hasegawa, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/421,337

(22) Filed: Oct. 18, 1999

(30) Foreign Application Priority Data

Oct. 19, 1998 (JP) ..... 10-297295

(51) Int. Cl.[7] ..... H01R 43/04
(52) U.S. Cl. ..... 29/564.4; 29/33 M; 29/753
(58) Field of Search ..... 29/564.4, 33 M, 29/564.6, 747, 748, 753, 759; 81/9.51

(56) References Cited

U.S. PATENT DOCUMENTS

| | | | | |
|---|---|---|---|---|
| 4,489,476 | * | 12/1984 | Over et al. | 29/564.4 |
| 4,506,566 | * | 3/1985 | Schmid | 29/564.4 X |
| 4,612,696 | * | 9/1986 | Talley | 29/564.4 |
| 4,616,386 | * | 10/1986 | Schmid | 29/33 M |
| 4,622,733 | * | 11/1986 | Fukuda et al. | 29/564.4 |
| 4,713,880 | * | 12/1987 | Dusel et al. | 29/564.4 |
| 4,964,200 | * | 10/1990 | Giesbrecht et al. | 29/564.4 X |
| 5,025,549 | * | 6/1991 | Hornung et al. | 29/564.4 |
| 5,168,613 | * | 12/1992 | Bair et al. | 29/33 M |
| 5,235,735 | * | 8/1993 | Koch | 29/564.4 |
| 5,490,316 | * | 2/1996 | Kimota | 29/564.4 |
| 5,784,770 | * | 7/1998 | Long, Jr. et al. | 29/33 M X |

FOREIGN PATENT DOCUMENTS 8-102354 4/1996 (JP) .

* cited by examiner

*Primary Examiner*—William Briggs
(74) *Attorney, Agent, or Firm*—Finnegan, Henderson, Farabow, Garrett & Dunner, L.L.P.

(57) ABSTRACT

An automatic cutting and crimping apparatus of the present invention includes a cutting and cover stripping section cutting an electric wire and stripping a cover of the electric wire, a terminal crimping section crimping a terminal to the electric wire, an electric wire carrying unit carrying the electric wire to the terminal crimping section by rotating around a rotary axis in a carrying direction, an elastic member applying a force to the electric wire carrying unit in a direction substantially opposite to the carrying direction, and an electric wire guiding section provided at a front end side of the electric wire carrying unit and guiding the electric wire to a send-out direction. Here the electric wire, sent out by a predetermined volume from the electric wire guiding section to the send-out direction, reaches the cutting and stripping section, and then the electric wire is rotated in the carrying direction so as to reaches the terminal crimping section.

7 Claims, 8 Drawing Sheets

AUTOMATIC CUTTING AND CRIMPING APPARATUS

BACKGROUND OF THE INVENTION

The present invention relates to an automatic cutting and crimping apparatus, and relates, more particularly, to an automatic cutting and crimping apparatus for cutting an electric wire (covered wire) to be used for a wiring harness (an assembled wire for a car) and for crimping a terminal (a compression ring) to both ends of the wire after stripping the wire of its cover at both ends.

Japanese Patent Application Laid-open No. 8-102354 discloses a both-end crimping apparatus for crimping both ends of a covered wire.

SUMMARY OF THE INVENTION

According to the investigation by the present inventor, there is considered available a both-end crimping apparatus 1 as shown in FIG. 8.

The apparatus 1 has a supply station 3 having a large number of wire supply tubes 3*a* on a base stand 2, as shown in FIG. 8.

The supply station 3 is provided to be able to move in both directions of an arrow mark e.

A turning arm 4 is provided at an exhaust side of the supply station 3. The turning arm 4 is provided with clamping means (not shown) for clamping an electric wire W supplied from the supply station 3.

The turning arm 4 can move (turn) freely in left and right directions as shown by an arrow mark with respect to the base stand around an axis 5. A head portion 4*a* of the turning head 4 is designed to be positioned at a reference position H, at a maximum turn processing position J that forms a maximum turn angle with the reference position H, and at an intermediate processing position I between these two points, respectively, by the turn of the turning arm 4. Further, the head portion 4*a* of the turning arm 4 is structured to face a wire cutting section 6A at the reference position H. to face a covered wire stripping section 6B at the intermediate position I, and to face a terminal crimping section 6C at the maximum turn processing position J, respectively.

Further, a first carrying section 7 is provided on the base stand 2, and this first carrying section 7 can move freely in an arrow mark n direction and an arrow mark m direction.

The first carrying section 7 is provided with four clamping sections of first to fourth clamping sections 7*a* to 7*d* at equal distances. The first clamping section 7*a* is moved between the reference position H and a first processing position K, the second clamping section 7*b* is moved between the first processing position K and a second processing position L, the third clamping section 7*c* is moved between the second processing section L and a third processing section M, and the fourth clamping section 7*d* is moved between the third processing section M and a fourth processing section N, respectively.

A second carrying section 8 is disposed at the first processing position K of the first carrying section 7, and this second carrying section 8 can move freely in an arrow mark p direction. The second carrying section 8 has a clamping section 8*a* and can carry a clamped wire W to a position opposite to a cover stripping section 6D by moving in the arrow mark p direction.

A third carrying section 9 is disposed at the second processing position L of the first carrying section 7, and this third carrying section 9 can move freely in an arrow mark q direction. The third carrying section 9 has a clamping section 9*a* and can carry a clamped wire W to a position opposite to a cover stripping section 6E by moving in the arrow mark q direction.

A clamping section 6F is provided at the third processing position M of the first carrying section 7, and a wire exhausting section 6G is provided at the fourth processing section N of the first carrying section 7.

Based on the above-described structure, at first, the electric wire W is supplied to the turning arm 4 from the supply station 3, and the supplied wire W is clamped by the clamping means not shown, with the front end side of the electric wire W set in a status of being projected from the head portion 4*a* of the turning arm 4.

Next, the electric wire W projected from the head portion 4*a* of the turning head 4 is cut by the wire cutting section 6A, and the turning arm 4 is turned from the reference position H to the intermediate processing position I.

Next, an insulating cover member at one end terminal of the electric wire W is stripped by the cover stripping section 6B, and the turning arm 4 is turned from the intermediate position I to the maximum turn processing position J.

Then, a terminal is crimped to a conductive wire of the electric wire W by the terminal crimping section 6C, and the turning arm 4 is returned from the maximum turn processing position J to the reference position H. Thus, a terminal processing at one end side of the electric wire W finishes.

When the turning arm 4 has returned to the reference position H, the first carrying section 7 moves in the arrow mark m direction to position the first clamping section 7*a* at the reference position H, and the electric wire W is drawn out by a predetermined volume by the head portion 4*a* of the turning arm 4. The first clamping section 7*a* of the first carrying section 7 clamps this drawn-out electric wire W, and the first carrying 7 moves in the arrow mark n direction to move the first clamping section 7*a* to the first processing position K.

Next, the clamping section 8*a* of the second carrying section 8 re-clamps the electric wire W, and the second carrying section 8 moves in the arrow mark p direction to move the electric wire W to a position near the cover stripping section 6D.

Next, an insulating cover member at the other end terminal of the electric wire W is stripped by the cover stripping section 6D, and then the second carrying section 8 returns to the original position.

Next, the second clamping section 7*b* of the first carrying section 7 is positioned at the first processing section K, and the second clamping section 7*b* re-clamps the electric wire W.

Next, the first carrying section 7 moves in the arrow mark n direction, and the second clamping section 7*b* moves to the second processing position L.

Next, the clamping section 9*a* of the third carrying section 9 re-clamps the electric wire W, and the third carrying section 9 moves in the arrow mark q direction to move the electric wire W to a position near the terminal crimping section 6E.

Next, a terminal is crimped to the other end terminal of the electric wire W by the terminal crimping section 6E, and thereafter the third carrying section 9 returns to the original position.

Next, the third clamping section 7*c* of the first carrying section 7 is positioned at the second processing position L, and the third clamping section 7*c* re-clamps the electric wire W.

Next, the first carrying section 7 moves in the arrow mark n direction to move the third clamping section 7*c* to the third processing position M.

Then, the clamping section 6F re-clamps the electric wire W, and the electric wire W is moved to the fourth processing position N by the move of the first carrying section 7, and the electric wire W is exhausted by the wire exhausting section 6G. Thus, the terminal processing at the other end side of the electric wire W also finishes.

According to the above-described apparatus 1, however, it is necessary to use a worm gear, a worm wheel, a belt, etc. as a mechanism for turn driving the turning arm 4. It is generally difficult to accurately position the turning arm 4 at each position of H, I and J, because of the backlash generated between the worm gear and the worm wheel at the time of stopping the turning arm 4 at each position of H, I and J. Particularly, the move volume of the head portion 4*a* at the front end of the turning arm 4 becomes large, and thus, it is considered difficult to secure a constant level of processing quality at each position of H, I and J.

With a view to solving the above-described problems, it is an object of the present invention to provide an automatic cutting and crimping apparatus capable of maintaining the processing quality at a high level by improving the precision of a stop position of an electric wire carrying unit at each part.

In order to achieve the above object, in the present invention, there is provided an automatic cutting and crimping apparatus comprising a cutting and cover stripping section cutting an electric wire and stripping a cover of the electric wire, a terminal crimping section crimping a terminal to the electric wire, an electric wire carrying unit carrying the electric wire to the terminal crimping section by rotating around a rotary axis in a carrying direction, an elastic member applying a force to the electric wire carrying unit in a direction substantially opposite to the carrying direction, and an electric wire guiding section provided at a front end side of the electric wire carrying unit and guiding the electric wire to a send-out direction. Here, the electric wire, sent out by a predetermined volume from the electric wire guiding section to the send-out direction, reaches the cutting and stripping section, and then the electric wire is rotated in the carrying direction so as to reaches the terminal crimping section.

According to the above aspect, based on the above-described structure, when the electric wire carrying unit stops at each work position, the electric wire guiding section at the front end side thereof stops practically with no deviation by the force applied by the elastic member, so that the precision of the stop at each work position improves.

Thus, the processing precision at each work position improves, and it is possible to continuously manufacture an electric wire of high quality having a terminal securely crimped to the wire.

More specifically, it is preferable that the elastic member is a coiled spring wound around the rotary axis from the viewpoint of space reduction.

In this case, more specifically, it is preferable that one end of the coiled spring is stopped by a pin member provided in the electric wire carrying unit, and the other end of the coiled spring is stopped by a pin member provided in a case member of a reduction gear mechanism communicated with the rotary axis, from the viewpoint of a secure installation.

On the other hand, it is preferable that the elastic member is a tension spring applying a tensile force to the electric wire carrying unit, from the viewpoint of space saving and cost reduction.

In this case, more specifically, it is preferable that one end of the tensile spring is stopped by a pin member provided in the electric wire carrying unit, and the other end of the tensile spring is stopped by a pin member of a bracket member provided in a case member of a reduction gear mechanism communicated with the rotary axis, from the viewpoint of a secure installation and preventing an unnecessary increase in the size of the case of the reduction gear.

In other words, the rotary axis is communicated with a driving source, and the elastic member reduces the backlash between the rotary axis and the driving source.

Of course, the electric wire carrying member may be movable in swinging manner.

DETAILED DESCRIPTION OF THE PREFERRED EMBODIMENTS

There will be explained in detail below embodiments of the present invention with reference to the appropriate drawings.

At first, an automatic cutting and crimping apparatus according to a first embodiment of the present invention will be explained.

Figure 1:
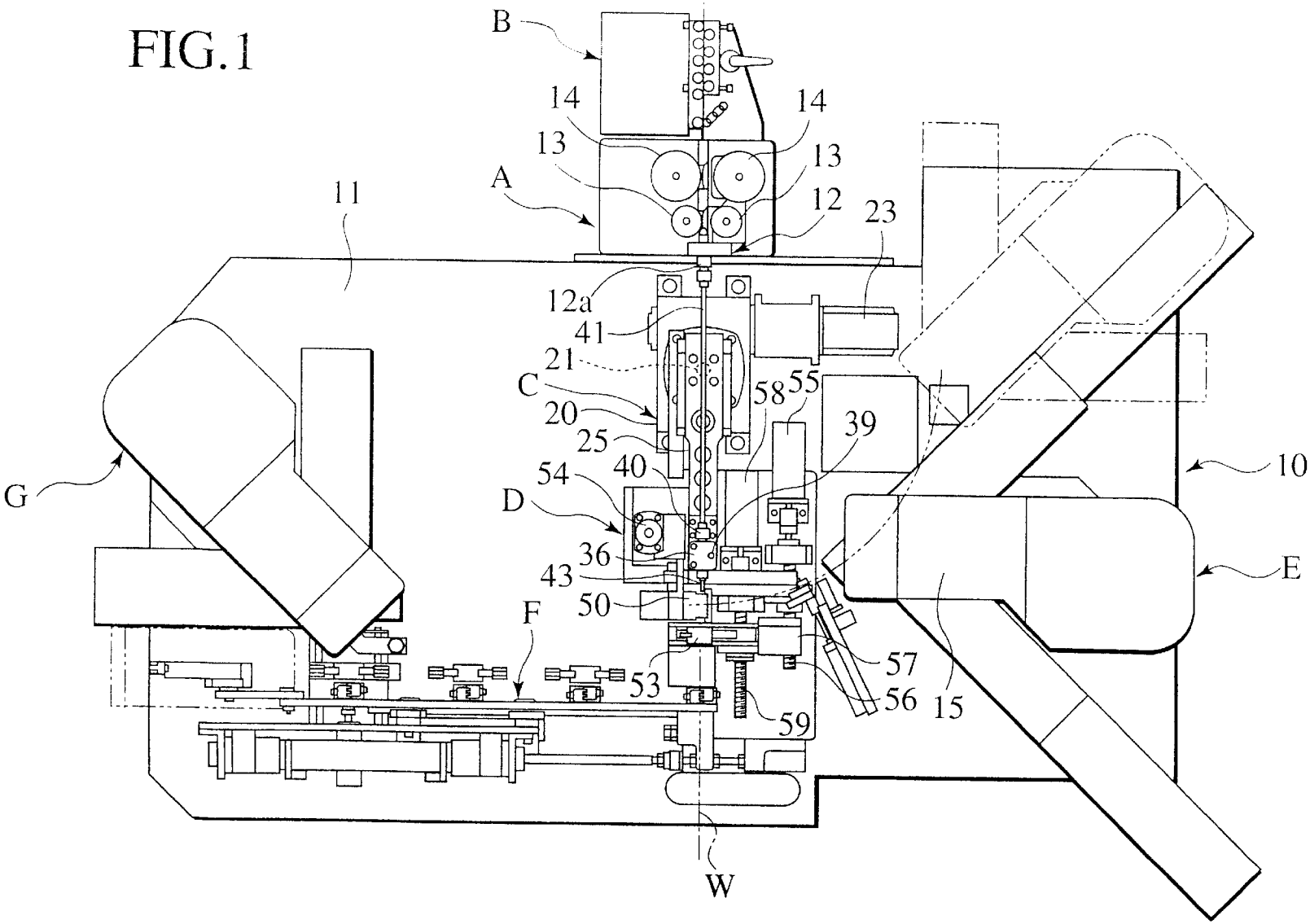
FIG. 1 is a whole top plan view of an automatic cutting and crimping apparatus according to a first embodiment of the present invention.

As shown in FIG. 1, an automatic cutting and crimping apparatus 10 is structured by the following members: a base stand 11; an electric wire size measuring unit A installed at the rear end of approximately the center of the base stand 11, for measuring an electric wire W at a predetermined length and then sending the electric wire W out; an electric wire correcting unit B installed at the rear end of the electric wire size measuring unit A, for correcting a bending and other distortion of the electric wire W and then sending the electric wire W to the electric wire size measuring unit A; an electric wire turning unit C installed at the rear side of approximately the center on the base stand 11, for carrying the electric wire W by turning; a cutting and stripping unit (a cutting and stripping section) D installed at approximately the center on the base stand 11 for cutting the electric wire W and stripping the electric wire W of its insulating cover member Wc at a cutting side of the electric wire W; a terminal crimping unit (a terminal crimping section) for one end terminal E installed at one side with respect to the center on the base stand 11, for crimping a terminal T to one end terminal Wa of the electric wire W having been stripped by the cutting and stripping unit D; an electric wire carrying unit F installed at the other side and the front portion form the center on the base stand 11, for carrying the electric wire W to one end of which the terminal T is crimped and which is cut with a predetermined length in such a state; and a terminal crimping unit for the other end terminal G installed at the other side on the base stand 11, for crimping a terminal T to the other end terminal Wb of the electric wire W having been carried by the electric wire carrying unit F.

The above will be explained in more detail. In referring to FIGS. 2 to FIG. 5, the electric wire turning unit C as a key part of the automatic cutting and crimping apparatus 10 is structured by: a reduction gear case 20 installed on the base stand 11 and having a rotary axis 21 rotatably supported at the center; a servomotor (a driving source) 23 installed on one side wall 20*a* of the reduction gear case 20, and having a worm gear 24 engaged with a worm wheel 22 fixed to a lower end 21*a* of a rotary axis 21, at the front end of a rotary axis 23*a*; and an electric wire carrying unit 25 fixed to an upper end 21*b* of the rotary axis 21 projected to the outside from the center of a ceiling wall 20*b* of the reduction gear case 20, for reciprocally carrying the electric wire W between the cutting and stripping unit D and the terminal crimping unit for one end terminal E.

The electric wire carrying unit 25 is structured by: an arm holder (base end) 26 having a U-shaped front surface, fixed to the upper end 21*b* of the rotary axis 21 and freely movable in left and right directions (turning); and a turning arm 27 supported freely swingingly in up and down directions by both side walls 26*a* and 26*a* projected to both sides of the base end of the arm holder 26, via a supporting axis 28.

A bolt 29 is screwed at the front side of the arm holder 26. The turning arm 27 is pierced through a shank portion not shown of the bolt 29. A front end 27*a* side of the turning arm 27 is always biased to the upside by a compressed coiled spring (elastic biasing member) not shown provided around the shank portion. The upward biasing of the turning arm 27 by this compressed coiled spring is restricted by a head portion 29*a* of the bolt 29.

Figure 3:
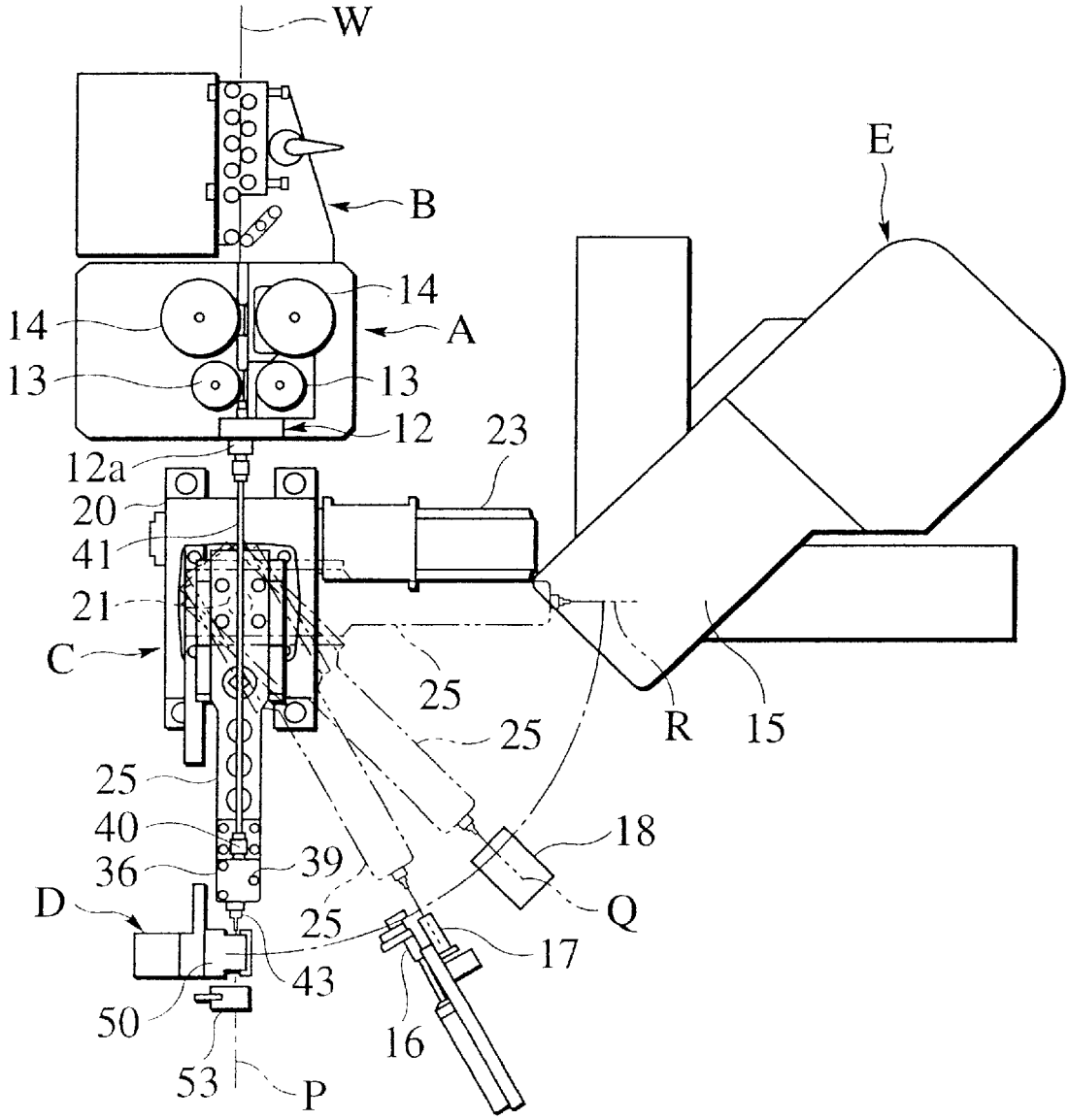
FIG. 3 is a top plan view of a part of the periphery of the electric wire turning unit according to the first embodiment of the present invention.

Further, the arm holder 26 is prevented from left and right oscillations (vibrations) at each stop position of an initial position (reference position) P of the electric wire carrying unit 25, an intermediate processing position Q for a soldering, and a terminal crimping position R, as shown in detail in FIG. 3, by the biasing force of a torsion coiled spring 30.

That is, specifically, a coil winding section 30*a* of the torsion coiled spring 30 is wound around the rotary axis 21. One end 30*b* of the torsion coiled spring 30 is stopped by a pin 31 projected to the lower side of the arm holder 26, and the other end 30*c* of the torsion coiled spring 30 is stopped by a pin 32 projected to the ceiling wall 20*b* of the reduction gear case 20.

Figure 5:
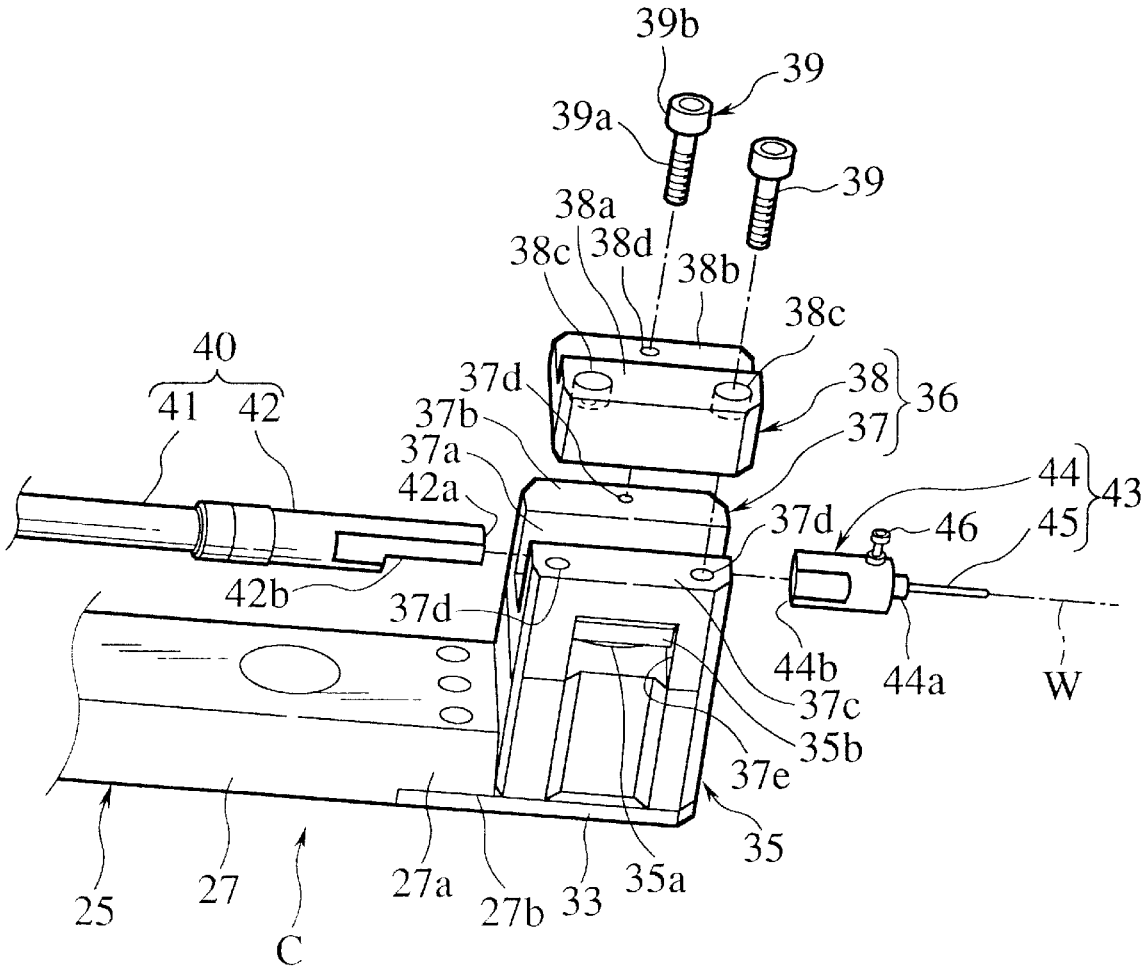
FIG. 5 is a perspective view of a key part of the electric wire turning unit according to the first embodiment of the present invention.

At a recessed portion 27*b* at the lower side of a front end 27*a* of the turning arm 27 shown in detail in FIG. 5, an air cylinder (a drive cylinder) 35 and a holder main body 37 for a holder 36 are fastened and fixed via a connection plate 33 and a plurality of bolts 34.

This holder 36 is structured by: the holder main body 37 having a recess portion 37*a* extending in a sending direction of the electric wire W, for accommodating a front end side of a guide tube 40 and a base end side of a nozzle 43 respectively; and a lid unit 38 installed via three bolts (fastening means) so as to cover this recess portion 37*a* between both side walls 37*b* and 37*c* of the recess portion 37*a* of the holder main body 37.

Figure 4:
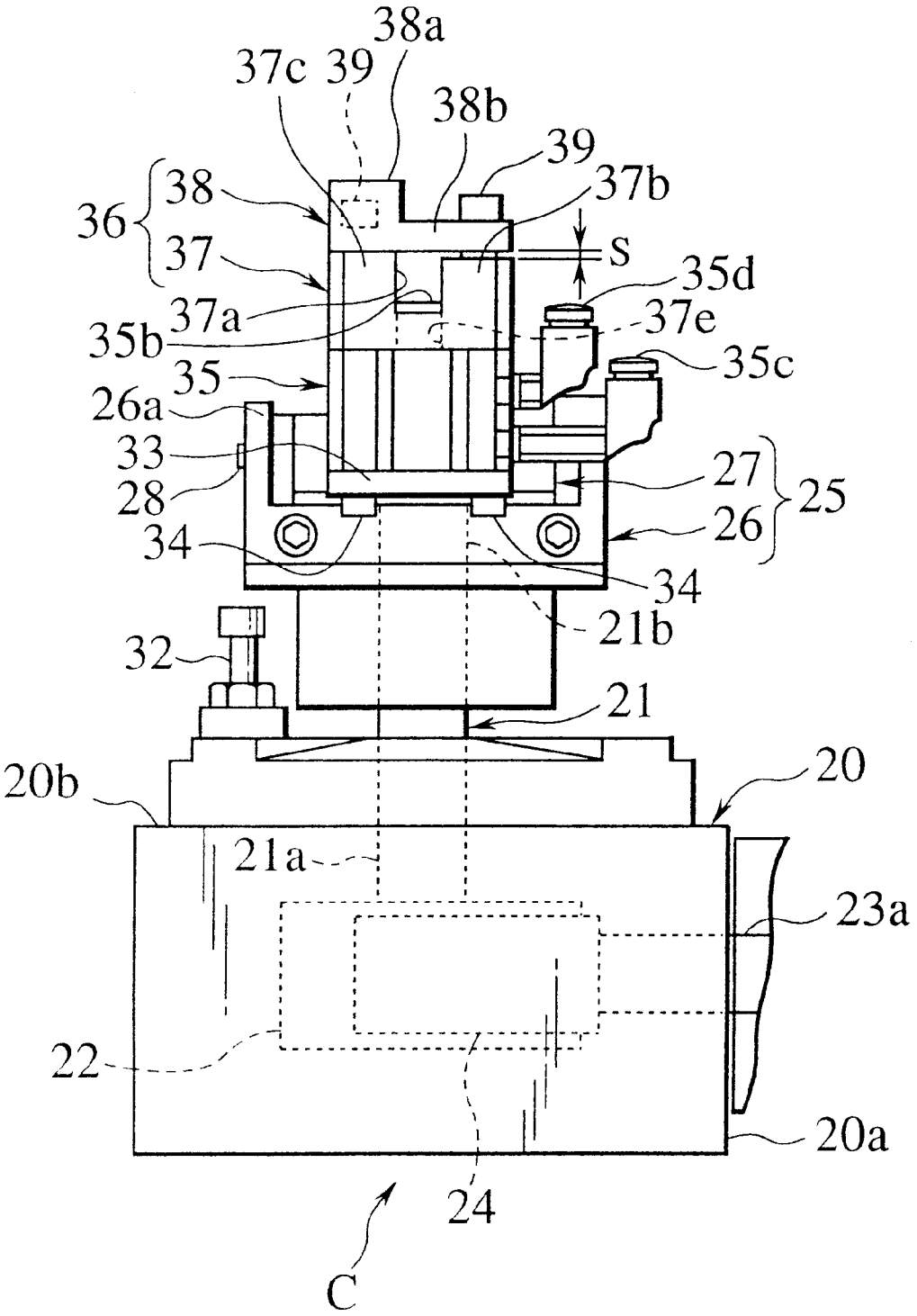
FIG. 4 is a front view of a part of the electric wire turning unit according to the first embodiment of the present invention.

In this case, of the side walls 37*b* and 37*c* of the holder main body 37, the height of the side wall 37*b* is made smaller than the height of the other side wall 37*c*. With this arrangement, as shown in FIG. 4, a space S is formed between the lower side wall 37*b* and the lid unit 38, and front end sides of a plurality of kinds of guide tubes 40 having different diameters and the base end side of the nozzle 43 are accommodated respectively between the recess portion 37*a* of the holder main body 37 and the lid unit 38, and this can be detachably installed by one bolt 39.

Screw holes 37*d* to be meshed with each bolt 39 are formed at the center on the upper surface of one side wall 37*b* of the holder main body 37 and at both sides on the upper surface of the other side wall 37*c*, respectively. Further, on both sides of a large-thickness portion 38*a* of the lid unit 38 opposite to each screw hole 37*d*, a pair of piercing holes 38*c* and 38*c* for piercing a shank portion 39*a* and a head portion 39*b* of the bolt 39 are formed respectively. At the center of a small-thickness portion 38*b* of the lid unit 38, a piercing hole 38*d* is formed for piercing the shank portion 39*a* of the bolt 39.

Figure 2:
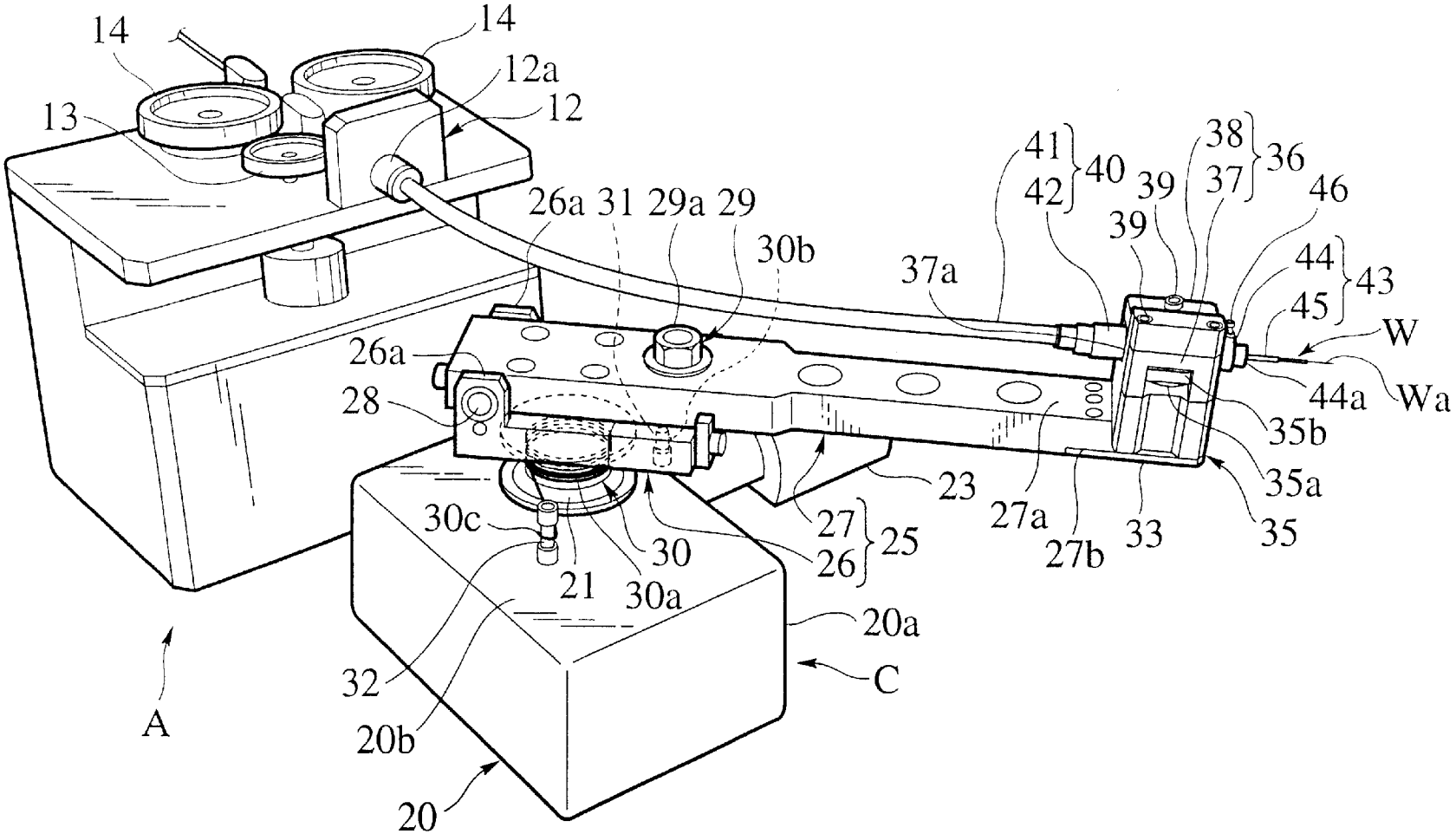
FIG. 2 is a perspective view of an electric wire turning unit according to the first embodiment of the present invention.

As shown in detail in FIG. 2 and FIG. 5, the guide tube 40 for inserting the electric wire W and guiding this electric wire W to its send-out direction, is structured by: a transparent tube made of an elastic resin extending from a cylinder portion 12*a* of a bracket 12 of the electric wire size measuring unit A; and an approximately cylindrical metal-made tube holder 42 communicated with the front end of the tube 41. A recess portion 42*b* is formed at the lower side of a front end 42*a* of a holder tube 42. A rectangular opening hole 37*e* is formed at the center of the recess portion 37*a* of the holder main body 37 (at a position opposite to the recess portion 42*b* of the holder tube 42 when accommodated in the recess portion 37*a*). Within the opening hole 37*e*, there is formed a pusher section 35*b* movable in forward and backward directions, integrally formed at the upper end of a piston rod 35*a* of the air cylinder 35. The electric wire W is measured by a pair of size measuring rollers 13 and 13, and is sequentially sent out to the inside of the tube 41 by a pair of send-out rollers 14 and 14.

Further, a nozzle (an electric wire guiding section) 43 communicated with the front end 42*a* of the tube holder 42 is structured by: a metal cylindrical nozzle main body 44 having approximately the same diameter as that of the tube holder 42; and a flexible tube 45 made of a closely adhered coiled spring or the like to be fixed to the inside of a cylindrical projecting portion 44*a* at the front side of the nozzle main body 44 via a bolt 46. The front end 42*a* of the tube holder 42 of the guide tube 40 and a base end 44*b* of the nozzle main body 44 of the nozzle 43 are communicated with each other at approximately the center within the recess portion 37*a* of the holder main body 37. The guide tube 40 and the nozzle 43 are selectively used to match the type or size of the electric wire W.

Further, as shown in detail in FIG. 1 and FIG. 6, the cutting and stripping unit D is structured by: a pair of upper and lower mobile units 50 and 50 for cutting and stripping the electric wire W; and a pair of upper and lower holders 53 and 53 for holding the electric wire W at the time of cutting and stripping the electric wire W. At the center of the opposite surfaces of the mobile units 50, a cutting blade 51 is provided in projection respectively. On both sides of each mobile unit 50, a stripping blade 52 is provided in projection. Each mobile unit 50 is set to be movable in upward and downward directions to be close to each other or apart from each other by a screw 54 rotated by a servomotor not shown, and is set movable in forward and backward directions by a screw 56 rotated by a servomotor 55. Each holder 53 is set to be movable in upward and downward directions to be close to each other or apart from each other by a driving mechanism 57 constituted by an air cylinder and a link or the like, and is set movable in forward and backward directions by a screw 59 rotated by a servomotor 58.

In FIG. 3, a reference numeral 15 denotes a terminal crimping device of the terminal crimping unit E, 16 denotes a cover stripping inspection section, 17 denotes a terminal crimping inspecting section, and 18 denotes an intermediate processing unit such as a soldering unit or the like.

In FIG. 4, reference numerals 35*c* and 35*d* denote air supply openings of the air cylinder 35. By changing over the supply, the pusher section 35*b* is moved upward and downward.

Each of the bolts 39 and 46 is formed with a hexagonal hole at its head, and each bolt is loosened by a tool of a hexagonal wrench not shown or the like.

The operation of the automatic cutting and crimping apparatus 10 having the above-described structure will be explained below.

At first, at an initial position (a reference position and a position opposite to the cutting and stripping unit D) P of the electric wire carrying unit 25 shown in FIG. 3, the electric wire W is sent out to within the tube 41 of the guide tube 40 of the electric wire carrying unit 25, through the electric wire correcting unit B and the pair of send-out rollers 14 and 14 of the electric wire size measuring unit A. Then, the electric wire W is further sent out by a predetermined volume from the front end (the flexible tube 45) of the nozzle 43 to the outside.

Next, in a status that the electric wire W is being sent out by the predetermined volume from the front end of the nozzle 43 to the outside, the electric wire W is held and fixed by the pusher section 35*b* of the piston rod 35*a* of the air cylinder 35 at the lower side of the front end of the electric wire carrying unit 25.

Figure 6A:
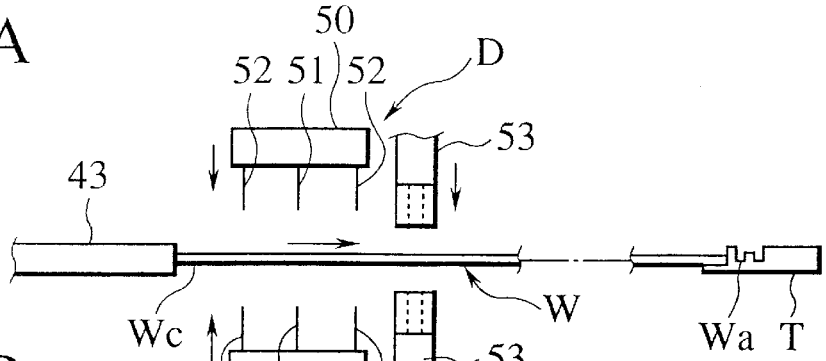
FIG. 6A is an explanatory view for showing a status that an electric wire is before being cut by a cutting and stripping unit according to the first embodiment of the present invention.
Figure 6B:
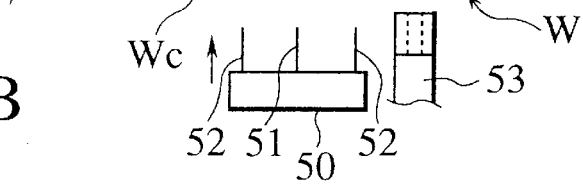
FIG. 6B is an explanatory view for showing a status that the electric wire is being cut by the cutting and stripping unit according to the first embodiment of the present invention.
Figure 6C:
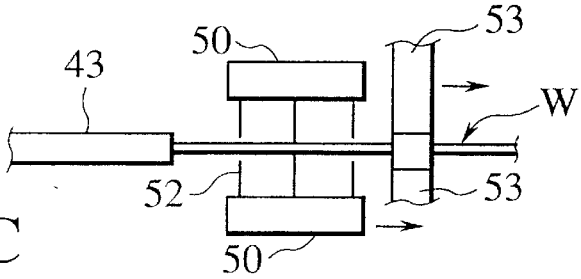
FIG. 6C is an explanatory view for showing a status that the electric wire is before being stripped by the cutting and stripping unit according to the first embodiment of the present invention.
Figure 6D:
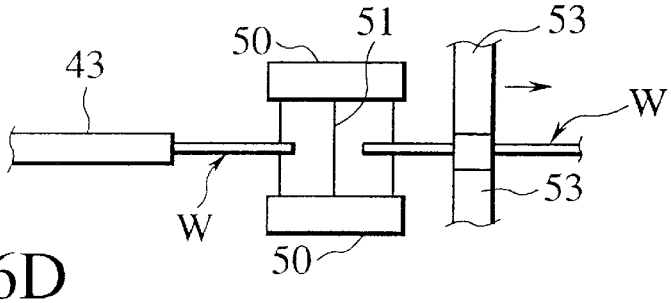
FIG. 6D is an explanatory view for showing a status that the electric wire is being stripped by the cutting and stripping unit according to the first embodiment of the present invention.
Figure 6E:
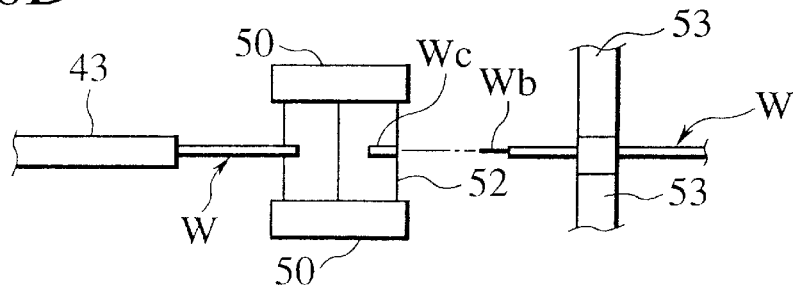
FIG. 6E is an explanatory view for showing a status that the electric wire has been stripped by the cutting and stripping unit according to the first embodiment of the present invention.
Figure 6E:
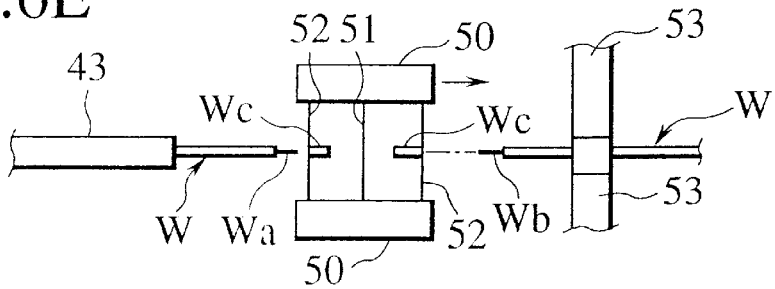

Next, as shown in FIG. 6A to FIG. 6C, the electric wire W held and fixed after having been sent out by the predetermined volume from the front end of the nozzle 43 to the outside, is cut via the pair of mobile units 50 and 50 and the pair of holders 53 and 53 of the cutting and stripping unit D. Thereafter, as shown in FIG. 6D and FIG. 6E, the electric wires W cut into two parts are stripped of their cover members Wc at both cut end sides respectively. Each arrow mark in these drawings indicates a move direction of each mobile unit 50 and each holder 53 respectively.

Next, the rotary axis 21 is rotated in a counter-clockwise direction through the servomotor 23, the worm gear 24 and the worm wheel 22, so that the electric wire carrying unit 25 is rotated by a predetermined angle, such as, for example, 45°, to the terminal crimping unit for one end terminal E side, and the nozzle 43 of the electric wire carrying unit 25 is stopped at the intermediate processing position Q such as for the soldering processing or the like.

Next, at the intermediate processing position Q, the front end side of the one end terminal Wa of the electric wire W after having been stripped is processed with the intermediate processing such as the soldering via the intermediate processing unit 18. Thereafter, the electric wire carrying unit 25 is further rotated by a predetermined angle, such as, for example, 45°, to the terminal crimping unit for one end terminal E side, and the nozzle 43 of the electric wire carrying unit 25 is stopped at the terminal crimping position R.

Next, at the terminal crimping position R, a terminal T is crimped to the terminal Wa at one end of the electric wire W having been stripped, via the terminal pressuring-welding device 15 of the terminal crimping unit E. In FIG. 6A, a status that the terminal T is crimped in such a manner is shown for convenience.

Next, after the terminal T has been crimped to the terminal Wa at one end of the electric wire W, the electric wire carrying unit 25 is returned to the original reference position P. Then, the other electric wire W is further sent out by a predetermined volume via the electric wire correcting unit B and the pair of send-out rollers 14 and 14 of the electric wire size measuring unit A, and is cut by the cutting and stripping unit D.

Then, the cover member Wc at the side of the terminal Wb of the other end of the electric wire W is stripped and such stripped electric wire W is carried to the terminal crimping unit for the other end terminal G by the electric wire carrying unit F. And a terminal T is crimped to the terminal Wb at the other end of the electric wire W.

That is, by sequentially repeating the above-described process, it is possible to continuously manufacture an electric wire W by a predetermined length, with the terminals T crimped to both ends Wa and Wb respectively.

In the present embodiment, the electric wire carrying unit 25 for carrying and stopping the electric wire W to the reference position P, the intermediate position Q and the terminal crimping position R is always being biased by the torsion spring force of the torsion coiled spring 30 toward the pin 32 projected on the ceiling wall 20*b* of the reduction gear case 20, when the electric wire carrying unit 25 stops at each stop position of P, Q and R.

Accordingly, when the electric wire carrying unit 25 stops at each stop position of P, Q and R, the oscillation of the nozzle at the front end of the electric wire carrying unit 25 is restricted effectively. In other words, even if there is a backlash between the worm gear 24 and the worm wheel 22, the oscillation of the nozzle 43 at the front end of the electric wire carrying unit 25 is securely prevented by the torsion spring force of the torsion coiled spring 30. Thus, a deviation of the nozzle 43 from the center of each stop position of P, Q and R can be prevented securely.

This leads to an improvement in the processing quality at each stop position of P, Q and R. Further, it becomes possible to manufacture a large volume of high-quality electric wires W fitted with the terminals T and rubber stoppers.

Further, in the present embodiment, as the precision of the reduction gear itself (the precision of the worm gear 24 and the worm wheel 22 built into the reduction gear case 20) is not required severely, it is possible to manufacture the automatic cutting and crimping apparatus 10 at low cost. Furthermore, as the coil winding section 30*a* of the torsion coiled spring 30 is wound around the rotary axis 21, it is possible to reduce the space for installing the torsion coiled spring 30, so that the electric wire turning unit C can be made smaller.

Next, there will be explained an automatic cutting and crimping apparatus according to a second embodiment of the present invention.

Figure 7:
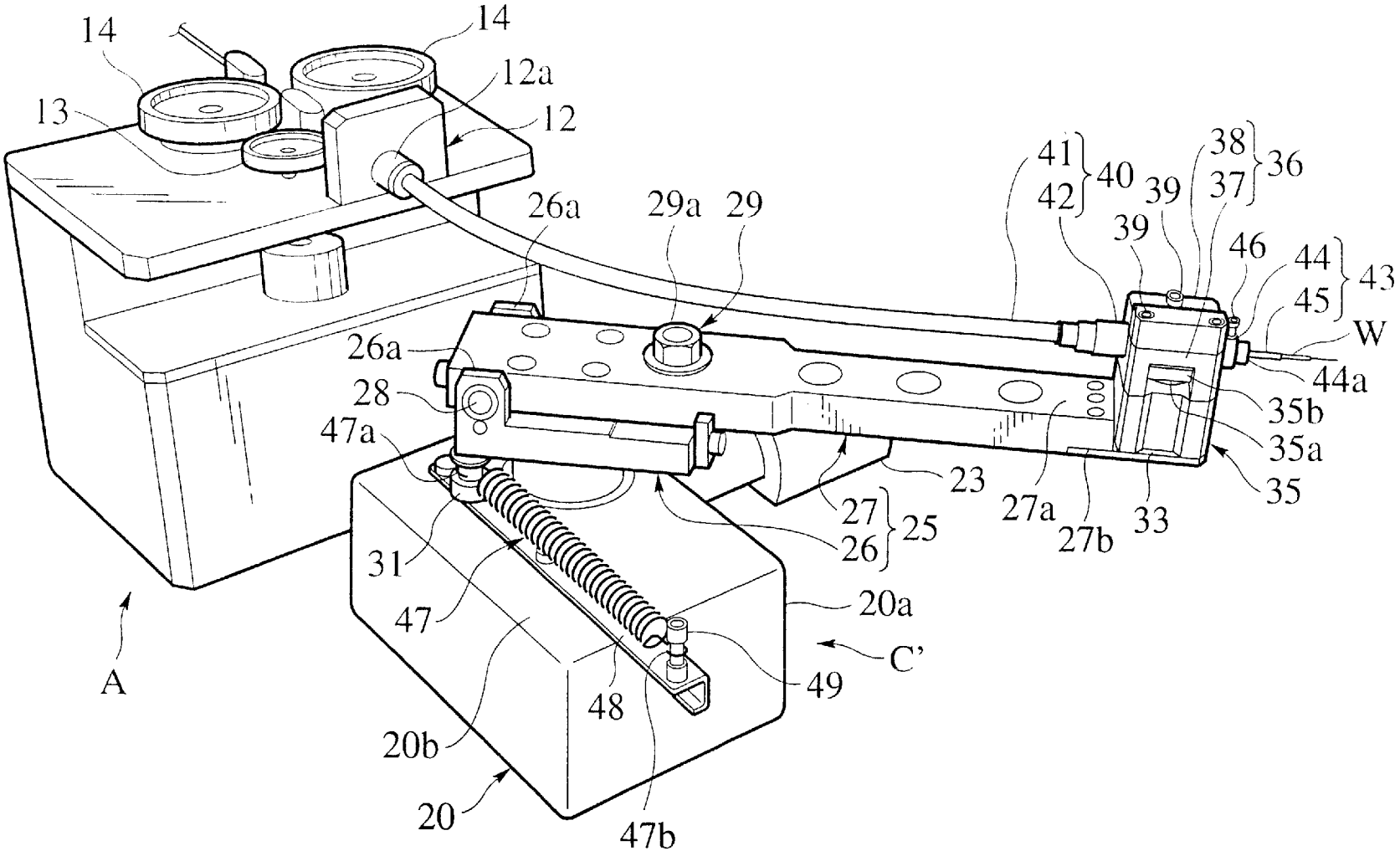
FIG. 7 is a perspective view for showing an electric wire turning unit as a key element of an automatic cutting and crimping apparatus according to a second embodiment of the present invention.
Figure 8:
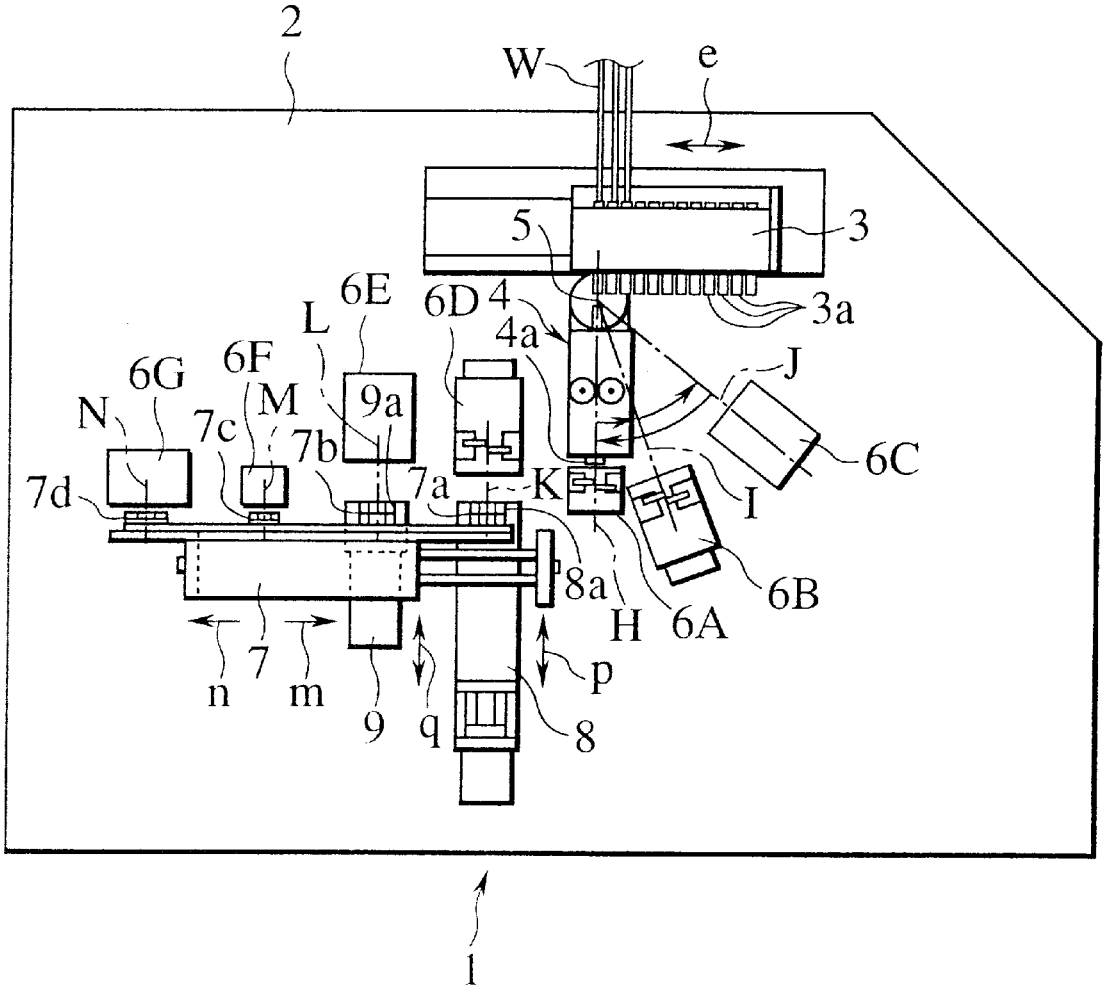
FIG. 8 is a schematic perspective view for showing a both-end crimping apparatus for a covered electric wire relating to an investigation by the present inventor.

As shown in FIG. 7, in the second embodiment, a tensile coiled spring (a tensile member) 47 is provided as a structure for restricting an oscillation of a nozzle 43 of an electric wire carrying unit 25 at each stop position of the reference position P, the intermediate processing position Q and the terminal crimping position R.

That is, specifically, the automatic cutting and crimping apparatus has a structure having one end 47*a* of the tensile coiled spring 47 stopped at a pin 31 projected to the lower surface of an arm holder 26 that becomes a base end of the electric wire carrying unit 25 and having the other end of 47*b* of the tensile coiled spring 47 stopped at a pin 49 at the front end of a bracket 48 stopped with a screw on a ceiling wall 20*b* of a reduction gear case 20. The rest of the structure is similar to that of the first embodiment, and the identical structural parts are attached with identical reference numerals, with their detailed explanation omitted.

According to the present embodiment, similar to the first embodiment, it is possible to restrict an oscillation of the nozzle 43 of the electric wire carrying unit 25 when the electric wire carrying unit 25 stops at each position of P, Q and R, so that the level of processing precision at each position of P, Q and R improves.

Further, as the tensile coiled spring 47 is used for restricting the oscillation of the nozzle 43, it is possible to further reduce the cost of the apparatus as a whole.

In the present embodiment, it is needless to mention that as a member for restricting the oscillation when the electric wire carrying unit stops, it is possible to use an elastic member capable of applying a similar tensile force in place of the tensile coiled spring.

Further, in each of the above embodiments, description has been made of the case where the electric carrying unit is rotated by a total 90° from the reference position to crimp a terminal to an end of stripped electric wire. However, it is needless to mention that the rotary position of the electric wire carrying unit for crimping the terminal is not limited to 90° and the electric wire carrying unit may be freely rotated to any angle, for example, 45°.

It is of course also possible to implement the present invention by making various modifications within the scope and technical idea of the present invention.

What is claimed is:

1. An automatic cutting and crimping apparatus, comprising:

a cutting and cover stripping section capable of cutting an electric wire and stripping a cover of the electric wire;

a terminal crimping section capable of crimping a terminal to the electric wire;

an electric wire carrying unit capable of carrying the electric wire to the terminal crimping section, wherein the electric wire carrying unit is rotatable around a rotary axis in a carrying direction;

an elastic member capable of applying a force to the electric wire carrying unit in a direction substantially opposite to the carrying direction; and an electric wire guiding section provided at a front end side of the electric wire carrying unit and capable of guiding the electric wire in an advancing direction, wherein the electric wire is advanced by a predetermined length from the electric wire guiding section in the advancing direction, the advanced electric wire reaches the cutting and stripping section so as to be cut and stripped, and then the electric wire is rotated in the carrying direction for crimping in the terminal crimping section.

2. An automatic cutting and crimping apparatus according to claim 1, wherein the elastic member is a coiled spring wound around the rotary axis.

3. An automatic cutting and crimping apparatus according to claim 2, wherein one end of the coiled spring is stopped by a pin member provided in the electric wire carrying unit, and the other end of the coiled spring is stopped by a pin member provided in a case member of a reduction gear mechanism communicated with the rotary axis.

4. An automatic cutting and crimping apparatus according to claim 1, wherein the elastic member is a tension spring applying a tensile force to the electric wire carrying unit.

5. An automatic cutting and crimping apparatus according to claim 4, wherein one end of the tensile spring is stopped by a pin member provided in the electric wire carrying unit, and the other end of the tensile spring is stopped by a pin member of a bracket member provided in a case member of a reduction gear mechanism in communication with the rotary axis.

6. An automatic cutting and crimping apparatus according to claim 1, wherein the rotary axis is in communication with a driving source, and the elastic member reduces the backlash between the rotary axis and the driving source.

7. An automatic cutting and crimping apparatus according to claim 1, wherein the electric wire carrying member is movable in swinging manner.

* * * * *

UNITED STATES PATENT AND TRADEMARK OFFICE

CERTIFICATE OF CORRECTION

PATENT NO. : 6,212,757 B1
DATED : April 10, 2001
INVENTOR(S) : Hiroshi Hasegawa

It is certified that error appears in the above-identified patent and that said Letters Patent is hereby corrected as shown below:

Title page,
Item [57], ABSTRACT, line 16, "to reaches" should read -- to reach --.

Signed and Sealed this

Ninth Day of April, 2002

*Attest:*

*Attesting Officer*

JAMES E. ROGAN
*Director of the United States Patent and Trademark Office*